US008931813B2

(12) United States Patent
Juga et al.

(10) Patent No.: US 8,931,813 B2
(45) Date of Patent: Jan. 13, 2015

(54) ROTARY LOCK PROVIDING POSITIVE LATCHING INDICIA

(75) Inventors: Douglas L. Juga, Kenosha, WI (US); Charles E. Bullock, Waukegan, IL (US)

(73) Assignee: A.L. Hansen Manufacturing Co., Waukegan, IL (US)

( * ) Notice: Subject to any disclaimer, the term of this patent is extended or adjusted under 35 U.S.C. 154(b) by 914 days.

(21) Appl. No.: 12/785,646

(22) Filed: May 24, 2010

(65) Prior Publication Data

US 2010/0308624 A1 Dec. 9, 2010

Related U.S. Application Data

(60) Provisional application No. 61/217,901, filed on Jun. 4, 2009.

(51) Int. Cl.

| | |
|---|---|
| ***E05C 3/02*** | (2006.01) |
| ***E05B 65/08*** | (2006.01) |
| ***E05B 13/00*** | (2006.01) |
| ***E05B 85/26*** | (2014.01) |
| ***E05C 3/24*** | (2006.01) |
| ***E05C 17/50*** | (2006.01) |
| ***E05B 83/04*** | (2014.01) |
| *E05C 7/00* | (2006.01) |
| *E05C 9/00* | (2006.01) |
| *E05C 19/00* | (2006.01) |

(Continued)

(52) U.S. Cl.

CPC ..... *E05B 65/0811* (2013.01); *E05B 13/004* (2013.01); *E05B 85/26* (2013.01); *E05C 3/24* (2013.01); *E05C 17/50* (2013.01); *E05B 83/04* (2013.01); *E05B 41/00* (2013.01)

USPC ..... 292/194; 292/3; 292/24; 292/29; 292/213; 292/216; 70/141

(58) Field of Classification Search

CPC ..... E05B 65/0811

USPC ..... 292/57, 59, 194, 242, 3, 14, 18, 24, 25, 292/27, 29, 201, 210, 216, DIG. 23, 213, 292/DIG. 27, DIG. 65; 70/141

See application file for complete search history.

(56) References Cited

U.S. PATENT DOCUMENTS

| | | | | |
|---|---|---|---|---|
| 2,530,330 | A * | 11/1950 | Groeger | 292/29 |
| 2,540,686 | A * | 2/1951 | Milburn | 292/124 |
| 3,198,564 | A * | 8/1965 | Welsh | 292/117 |

(Continued)

OTHER PUBLICATIONS

Figure 1A—3B for U.S. Appl. No. 12/785,646, filed May 24, 2010, 1 page.

*Primary Examiner* — Kristina Fulton
*Assistant Examiner* — Faria Ahmad
(74) *Attorney, Agent, or Firm* — Brinks Gilson & Lione

(57) ABSTRACT

A rotary lock including a housing having a strike channel shaped to receive a strike component and a latch member including at least one strike engaging member. The latch member is rotatable between an unlatched position, a secondary latch position and a primary latch position. A keeper member is moveable between a disengaged position, a secondary keeper position, and a primary keeper position. A lock member is moveable between a lock position and an unlock position. The lock member and/or a lock actuator is non-movable to the lock position when the latch member is in the secondary latch position, thereby providing indicia that the latch member is not fully latched in a primary latch position. Methods of assembly and use are also provided.

27 Claims, 6 Drawing Sheets

(51) Int. Cl.
*E05C 3/12* (2006.01)
*E05B 41/00* (2006.01)

(56) References Cited

U.S. PATENT DOCUMENTS

| | | | | | |
|---|---|---|---|---|---|
| 3,705,505 | A | | 12/1972 | Landow et al. | |
| 3,905,627 | A | | 9/1975 | Fujita | |
| 4,007,955 | A | | 2/1977 | Kobayashi | |
| 4,123,096 | A | | 10/1978 | Ardizio | |
| 4,208,837 | A | | 6/1980 | Black, Sr. et al. | |
| 4,427,223 | A | | 1/1984 | Godec et al. | |
| 4,457,146 | A | * | 7/1984 | Weinerman | 70/100 |
| 4,511,166 | A | * | 4/1985 | Weinerman | 292/29 |
| 4,835,997 | A | * | 6/1989 | Akright | 70/141 |
| 4,917,420 | A | * | 4/1990 | Rogers, Jr. | 292/198 |
| 5,137,311 | A | * | 8/1992 | Brackmann | 292/216 |
| 5,221,115 | A | * | 6/1993 | Takimoto | 292/29 |
| 5,288,115 | A | * | 2/1994 | Inoue et al. | 292/201 |
| 5,520,423 | A | * | 5/1996 | Finkelstein et al. | 292/146 |
| 5,526,659 | A | * | 6/1996 | Takimoto | 70/99 |
| 5,540,066 | A | * | 7/1996 | Takimoto | 70/99 |
| 5,573,287 | A | * | 11/1996 | Takimoto | 292/29 |
| 5,979,949 | A | * | 11/1999 | Finkelstein et al. | 292/29 |
| 6,023,953 | A | * | 2/2000 | Vickers et al. | 70/208 |
| 6,059,327 | A | * | 5/2000 | Yoshikuwa | 292/216 |
| 6,688,658 | B2 | * | 2/2004 | Mori et al. | 292/56 |
| 8,276,950 | B2 | * | 10/2012 | Kutschat | 292/216 |
| 2003/0015879 | A1 | * | 1/2003 | Finkelstein et al. | 292/213 |
| 2010/0019513 | A1 | * | 1/2010 | Generowicz et al. | 292/242 |

* cited by examiner 68
30
34
70
172
170
102
106
94
92
158
150
152
98
236
84
232
230
234
240
96
85
156
160
108
164
162
242
166

ROTARY LOCK PROVIDING POSITIVE LATCHING INDICIA

This application claims the benefit of U.S. Provisional Application No. 61/217,901, filed Jun. 4, 2009, the entire disclosure of which is hereby incorporated herein by reference.

FIELD OF THE INVENTION

The present invention relates generally to a rotary lock, and in particular, to a rotary lock providing positive indicia about the latched condition of the lock, and to the method for the use thereof.

BACKGROUND

Rotary latches, for example those used on automobiles, are often configured to operate in two latching stages; a fully latched condition, or primary stage, and a partially latched condition, or secondary stage. In vehicles configured with rotating doors, it is usually apparent when the door is in the secondary stage since the door is visibly ajar. In addition, such vehicles are often configured with auxiliary warning indicia, including for example warning lights or audible indicators signaling that the door is not fully latched. Other vehicles, however, employ sliding doors, which can be slid between closed and open positions. In such vehicles, a double rotary latch, such as disclosed in U.S. Pat. No. 4,835,997 (the entire disclosure of which is hereby incorporated herein by reference), engage opposing strike components in respective open and closed positions. For example, a double rotary latch is shown with a latch member 30 in a fully latched condition in FIGS. 1A-B, in a partially latched condition in FIGS. 2A-B and in an unlatched position in FIGS. 3A-B, with a keeper member 102 engaging the latch member 30 in the latter two positions. Typically, doors configured with such latches do not indicate to the user that the latch is in the secondary stage. For example, it may be difficult to visually discern whether such a sliding door is in a primary or secondary stage.

Exacerbating this problem, it may be possible in some instances for the user to turn a key and associated lock member 41 proximate a lock position (e.g., 90 degrees), even when the latch member 30 is in the secondary stage (see FIGS. 2A-B, cam 81 rotatable by key (not shown)), thereby providing a false sense of security that the lock is fully latched and locked, and providing a false positive indicator that the door is fully latched. This false positive concerning the latched condition of the door is particularly problematic when viewed from the exterior, where the rotational range of the key may be the only indicia concerning the latched condition, thereby leading the operator to assume that the door is latched if it is lockable by way of a full rotation (90°) of the key. If the lock is positioned in a secondary latch stage, then it is easier for the door to be tampered with and opened by unauthorized personnel, even if the lock member 41 partially engages the latch member 30 in a pseudo-lock position as shown in FIG. 2A.

SUMMARY

The present invention is defined by the following claims, and nothing in this section should be considered to be a limitation on those claims.

In one aspect, one embodiment of a rotary lock includes a housing having a strike channel shaped to receive a strike component and a latch member having at least one strike engaging member adapted to releasably engage the strike component. The latch member is rotatable about a rotation axis between an unlatched position wherein the strike engaging member is positioned such that the strike component can be received in the strike channel, a secondary latch position wherein the strike engaging member at least partially blocks the strike channel and a primary latch position wherein the strike engaging member substantially blocks the strike channel. A keeper member is moveable between a disengaged position wherein the keeper member is disengaged from the latch member, a secondary keeper position wherein the keeper member is engaged with the latch member when the latch member is in the secondary latch position, and a primary keeper position wherein the keeper member is engaged with the latch member when the latch member is in the primary latch position. A lock member is moveable between a lock position and an unlock position, wherein the lock member is engaged with and prevents rotation of the latch member when the latch member is in the primary latch position and the lock member is in the lock position. The lock member is disengaged from the latch member when the latch member is in the unlock position, and the lock member is non-movable to the lock position when the latch member is in the secondary latch position.

In another aspect, a vehicle includes a doorway having first and second strike members disposed on opposite sides thereof. A sliding door is moveable between a closed and open position relative to the doorway. A rotary lock is coupled to the sliding door. The lock includes a lock member that is non-movable to a lock position when a latch member is in a secondary latch position, thereby providing indicia to the user that the door is not fully latched.

In yet another aspect, a rotary lock includes a housing having first and second strike channels positioned on opposite sides of said housing and shaped respectively to receive first and second strike components. A latch member includes opposing first and second strike engaging members adapted to releasably engage respectively the first and second strike components. The latch member is rotatable about a rotation axis between an unlatched position, a secondary latch position and a primary latch position. A keeper member is moveable between a disengaged position wherein the keeper member is disengaged from the latch member such that the latch member is rotatable between the primary and unlatched positions, a secondary keeper position wherein the keeper member is engaged with the latch member when the latch member is in the secondary latch position, and a primary keeper position wherein the keeper member is engaged with the latch member when the latch member is in the primary latch position. A lock member is moveable between a lock position and an unlock position. The lock member is engaged with and prevents rotation of the latch member when the latch member is in the primary latch position and the lock member is in the lock position, while the lock member is disengaged from the latch member when the lock member is in the unlock position. A lock blocker is rotatable about the rotation axis between an engaged position, wherein the lock blocker engages the lock member and prevents the lock member from being moved to the lock position when the latch member is in the secondary latch position, and a disengaged position, wherein the lock blocker does not impede the movement of the lock member to the lock position.

In another aspect, a method of locking a sliding door in an open or closed position includes moving a sliding door comprising a rotary latch relative to a door opening having first and second strike members and disposing one of the first and second strike elements through one of a first and second strike channel formed in the rotary latch and thereby rotating a latch member with the first or second strike element from an unlatched position to a secondary latch position. The method further includes engaging a keeper member with the latch member as the latch member is rotated to the secondary latch position, and preventing a lock member from moving to a lock position when the latch member is in the secondary latch position, thereby providing indicia that the latch member is not in a primary latch position. The method further includes rotating the latch member with the first or second strike element from the secondary latch position to the primary latch position, engaging the keeper member with the latch member as the latch member is rotated from the secondary latch position to the primary latch position, and moving the lock member to a lock position and thereby engaging the latch member with the lock member when the latch member is in the primary latch position.

The various embodiments of the rotary lock, and methods for the use thereof, provide significant advantages over other rotary locks. For example and without limitation, the user will not be able to rotate the lock member, and/or an associated actuator such as a key, to a lock position when the latch member is in the secondary latch position. Instead, the rotation of the key is extremely limited, or precluded entirely, in a locking rotational direction, thereby indicating to the user that the door is not fully latched in a primary latch position. In response to this information, the user can fully latch and then lock the door, thereby providing increased security for the vehicle and its contents.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

It should be understood that the term "plurality," as used herein, means two or more. The term "longitudinal," as used herein means of or relating to length or the lengthwise direction. The term "lateral," as used herein, means situated on, directed toward or running from side to side. The term "coupled" means connected to or engaged with whether directly or indirectly, for example with an intervening member, and does not require the engagement to be fixed or permanent, although it may be fixed or permanent, and includes both mechanical and electrical connection.

Figure 15:
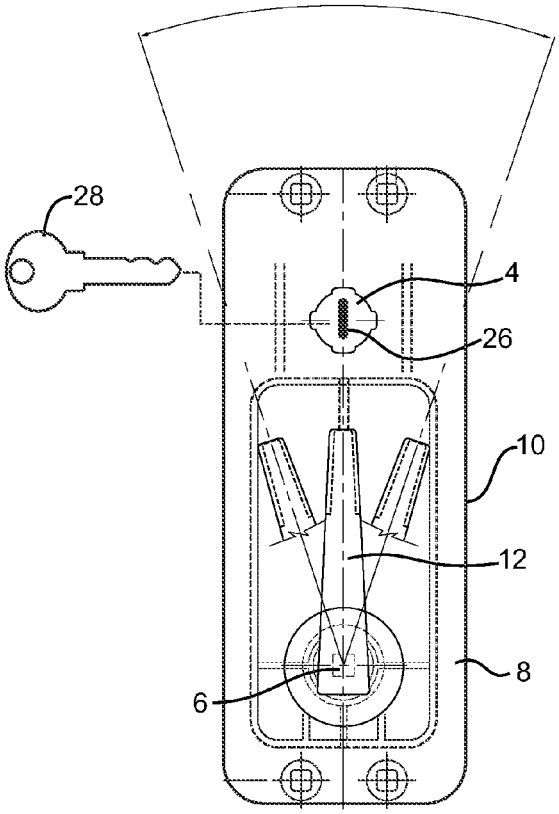
FIG. 15 is a view of the outside of a sliding door with a rotary lock coupled thereto.
Figure 16:
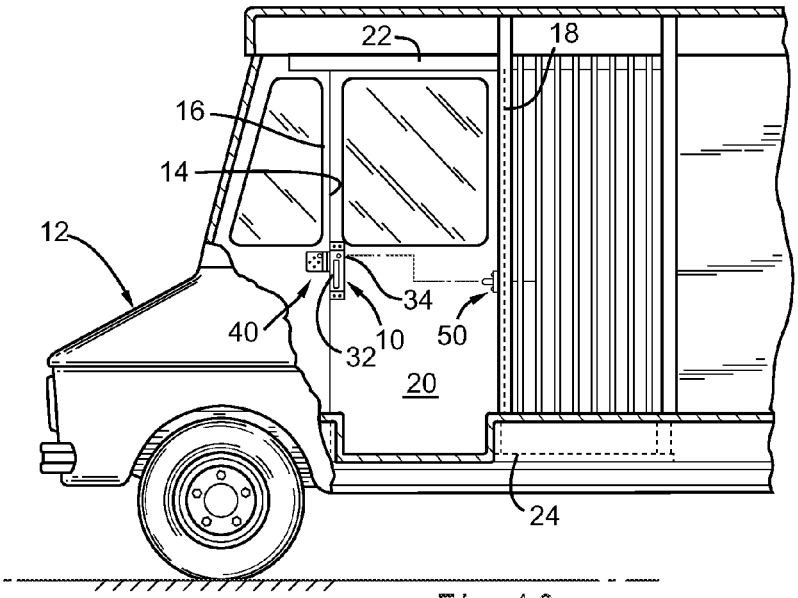
FIG. 16 is an interior elevation view of a portion of a vehicle with a sliding door and rotary latch.

Referring to FIGS. 15 and 16, a vehicle 12 is configured with a doorway 14 having first and second strike members 40, 50 disposed on opposite sides thereof and mounted to frame members 16, 18. A sliding door 20 is moveable on upper and lower guides 22, 24 between a closed and open position relative to said doorway. A rotary lock 10 is coupled to the sliding door, and is configured to releasably engage the first strike member 40 when the door 20 is closed and to releasably engage the second strike member 50 when the door 20 is open. A first actuator 12, shown as a handle or lever, is secured to a plate member 8 and is rotatable about a rotation axis 6. An exterior lock actuator, shown as a lock cylinder 4 having a key passageway 26 is coupled to the plate member. A key 28 may be inserted into the passageway 26 and then rotated to move the lock actuator, and associated lock member 130, from an unlocked position to a locked position. The handle 12 is accessible from the exterior of the vehicle and is rotated to disengage a latch member 30 from one of the strike members 40, 50, thereby permitting the door 20 to be slid between the open or closed position. The key 28 may be rotated to lock the latch member 30 and prevent the strike member 40, 50 from being disengaged therefrom, or to unlock the latch member 30 and thereby permit the handle 12 to be rotated to unlatch the door 20. In one embodiment, the key 28 is rotatable 90° from a neutral position to a lock position in a first rotation direction, and is rotatable 90° from a neutral position to an unlock position in a second rotation direction opposite the first rotation direction. The key is insertable into the key passageway when in the neutral position, and is not removable from the passageway when in either of the lock or unlock positions. In one embodiment, the key has a substantially vertical orientation when in the neutral, insertion position, and has a substantially horizontal orientation when in either of the lock or unlock positions.

Figure 13:
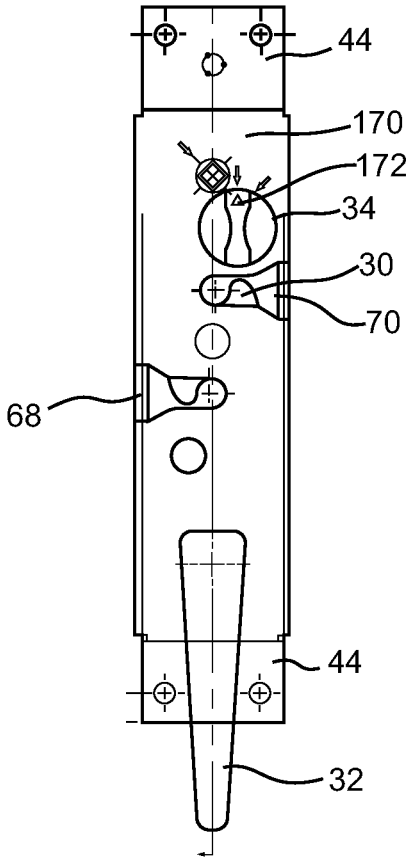
FIG. 13 is a first side view of the rotary lock shown in FIG. 7A.
Figure 14:
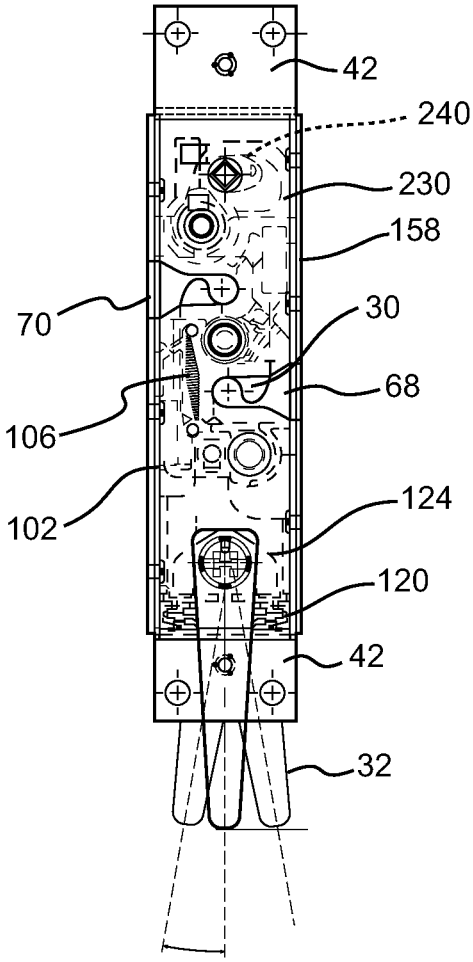
FIG. 14 is a second side view of the rotary lock shown in FIG. 13.

Referring to FIGS. 13 and 16, a second, interior handle 32 is provided. The interior handle also may be rotated to unlatch the door 20. An interior lock actuator 34, shown as a knob or lever, is provided to lock or unlock the latch member 30.

As shown in FIGS. 11-14, the rotary lock includes a housing 2. The housing includes first and second housing components 36, 38, each having a pair of opposite end flanges 42, 44. Each housing component has a top plate 46, 48 and four side walls 52, 54, 56, 58 forming a recess 62, 64 in each housing component respectively, with the recess 64 of the second housing being deeper than the recess 62 of the first housing by virtue of the height of the respective side walls. The flanges 42, 44 of the first and second housing components are mated together, with the first housing nesting in the second housing component such that a space is formed between the respective top plates 46, 48.

The second housing component 38 has a pair of longitudinally offset openings 68, 70 formed in opposite side walls 58 thereof, with the openings further extending from the side walls inwardly along the top plate. The openings 68, 70 define a pair of offset strike channels, each positioned and shaped to receive one of the first and second strike members 40, 50. The first and second housing components each have an opening 72 shaped to receive coaxial shaft(s) 74. Opposite ends of the shaft(s) 74 are non-rotatably coupled to the exterior and interior handles 12, 32, for example by way of non-circular interfacing sockets. At least the first housing component further includes an opening 76 shaped and positioned to receive a shaft 78 extending from the lock cylinder 4. Conversely, at least the second housing component 38 includes an opening shaped 82 and positioned to receive a shaft 84 extending from the interior lock actuator 34. Of course, it should be understood that the openings in either housing component can be formed in the other housing component, or that the interior and exterior lock actuators may be coaxial.

Referring to FIGS. 4A-6B, 7A-9B, 10-12 and 14, the rotary latch includes a latch member 30 rotatably mounted about a rotational axis 92 in the space or recess formed between the first and second housing components. The latch member includes a pair of laterally offset strike engaging members 94 extending in opposite directions relative to each other. The latch member 30 further includes a latching portion 90 laterally offset from a locking portion 98, each configured with a catch configuration 96. In one embodiment, each of the strike engaging members, latching portion and locking portion are configured as arms. In one embodiment, each catch configuration 96 includes at least one tooth, or corresponding recess shaped to receive a tooth or protuberance. Of course, it should be understood that other types of catch configurations, including various detents, deformable interfaces, hook and loop fasteners, indexing members, etc., and/or combinations thereof, may also work. The latching and locking portions 90, 98 are offset from respective ones of the strike engaging members 94 so as to form opposing recesses 86, 88 therebetween, with the recesses dimensioned and shaped to receive respective ones of the strike members.

A keeper member 102 is rotatably mounted in the recess between the first and second housing components about a second rotation axis 104, which is parallel to and spaced from the first rotation axis 92. The keeper member includes a catch configuration 108, including at least one tooth in one embodiment. A biasing member 106, shown as a tension spring, extends between and is coupled to the latch member 30 and keeper member 102. The biasing member 106 biases the latch member 30 and keeper member 102 toward each other, such that rotation of either of those members in one rotational direction (e.g., clockwise or counterclockwise) about its axis 92, 104 tends to rotate the other member in the same rotational direction.

An actuator 110 includes a spring plate 112 having a lug 114 with an opening 116, shown as a slot, engaged with a post 118 protruding from the keeper at a spaced apart location from the rotation axis. A biasing member 120, configured in one embodiment as a pair of compression springs, are positioned between a bottom 122 of the actuator and a bottom side wall 56 of the second housing component 38. It should be understood that the biasing member can be configured as a single tension spring, one or more compression, torsion or cantilever springs. The actuator further includes a rocker cam 124 non-rotatably mounted on the post(s) 74 extending between the handles 32, 12. Rotation of either handle rotates the rocker cam 124, which thereby engages and moves the spring plate 112 downwardly away from the keeper member 102 against a biasing force of the biasing member 120. As a result, the keeper member 102 is rotated away from the latch member 30, and the corresponding catch configurations 108, 96 are thereby disengaged from each other. At the same time the biasing member 106 pulls the latch member 30 and rotates the latch member 30 to an unlatched position.

A lock member 130, 230 is non-rotatably mounted to the interior actuator 34, for example by a non-rotatable interface with the shaft 84, and is rotatable about a pivot axis 85 defined thereby. The lock member 130, 230 is configured with a catch configuration 132, 232, which may include at least one tooth or a recess defined thereby. The lock member has an opening 134, 234 defining a cam profile/surface 136, 236. A cam member 140, 240 is disposed in the opening 134, 234 and is non-rotatably secured to the post or shaft 78 of the exterior lock actuator, such that rotation of the shaft/post, for example by rotation of the key 28, rotates the cam member about an axis 144. The cam member has an exterior cam profile/surface 142, 242 that engages the interior cam surface 136 of the lock member as the exterior lock actuator is rotated. Of course, it should be understood that the positions of the exterior and interior lock actuators could be reversed.

Referring to the embodiment of FIGS. 7A-12, a lock blocker 150 is rotatably mounted about the rotation axis 92 in the recess between the housing components. The lock blocker 150 includes a catch configuration 152, formed in one embodiment as a tooth on an end portion of an arm. The lock blocker further includes an engagement portion 154, or shoulder, extending along and releasably engageable with an edge 156 of the locking portion 98 of the latch member. A biasing member 158, shown as torsion spring, biases the lock blocker 150 into rotational engagement with the latch member 30, and in particular biases the engagement portion 154 against the edge 156 of the latch member. The spring includes a first arm portion 160 fitted in a channel formed in an arm portion of the lock blocker. A second arm portion 162 of the spring is fitted in a channel formed in a cover 164 that is secured around the rotational axis 104 of the keeper member 102. It should be understood that the biasing member can be configured as a tension spring, compression spring, cantilever spring, or other known types of biasing members. A second cover 166 is fitted against the side of the lock blocker and maintains the lateral position of the engagement portion 154 relative to the edge of the latch member 156.

In operation, and starting with the door 20 in an intermediate, unlatched position, a user slides the door to an open or closed position. Prior to engagement of the latch member 30 with one of the strike components 40, 50 the latch member should be in an unlatched position, with the strike engaging members 94 positioned such that the strike component can be received in the strike channel 68, 70 as shown for example in FIGS. 6A and 9A. In one embodiment, the strike engaging members 94 are disposed substantially entirely outside of the strike channel 68, 70. In this position, the latching portion 90 and locking portion 98 of the latch member present strike surfaces across the respective strike channels 68, 70, which strike surfaces may be engaged by the corresponding strike components 50, 40.

Figure 6A:
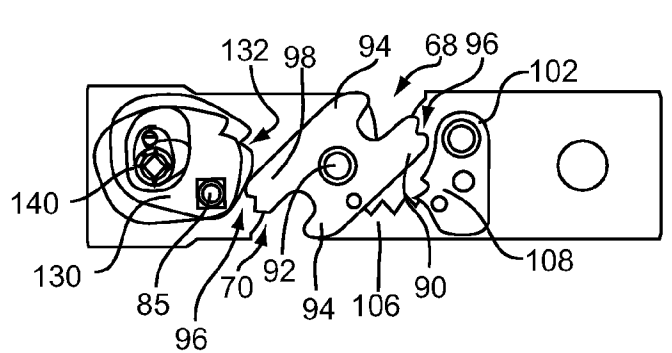
FIG. 6A is a schematic interior view of the rotary lock shown in FIG. 4A with the latch member in an unlatched position and the lock member in the lock position.
Figures 7A, 7B, 8A, 8B, 9A, 9B, 10:
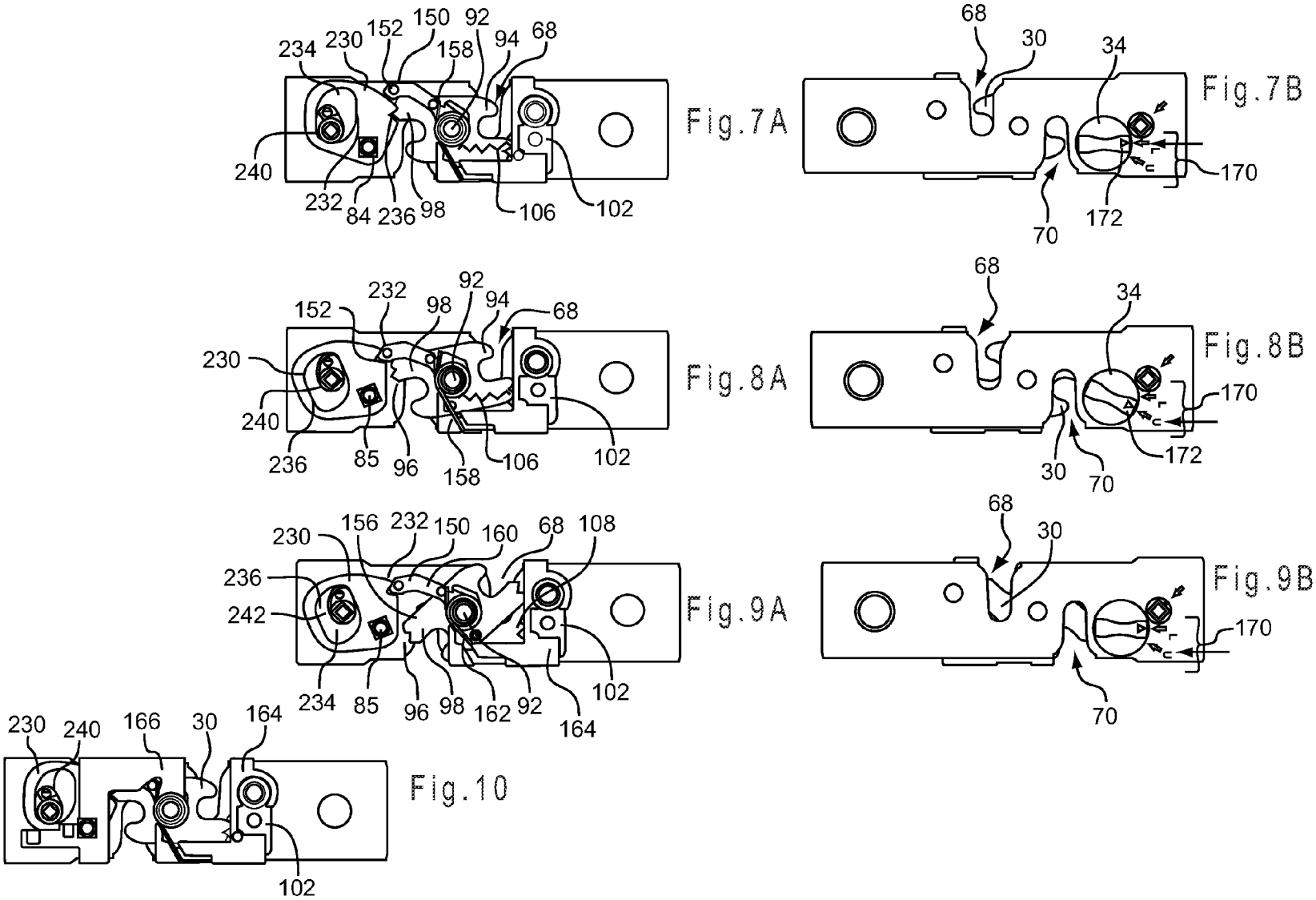
FIG. 7A is a schematic interior view of a second embodiment of a rotary lock with a latch member in a primary latch position and a lock member in a lock position.
FIG. 7B is a schematic exterior view of the rotary lock shown in FIG. 7A.
FIG. 8A is a schematic interior view of the rotary lock shown in FIG. 7A with the latch member in a secondary latch position and the lock member in an unlocked position.
FIG. 8B is a schematic exterior view of the rotary lock shown in FIG. 8A.
FIG. 9A is a schematic interior view of the rotary lock shown in FIG. 7A with the latch member in an unlatched position and the lock member in the unlocked position.
FIG. 9B is a schematic exterior view of the rotary lock shown in FIG. 9A.
FIG. 10 is an interior view of the rotary lock shown in FIG. 7A with a pair of covers applied thereto.
Figure 11:
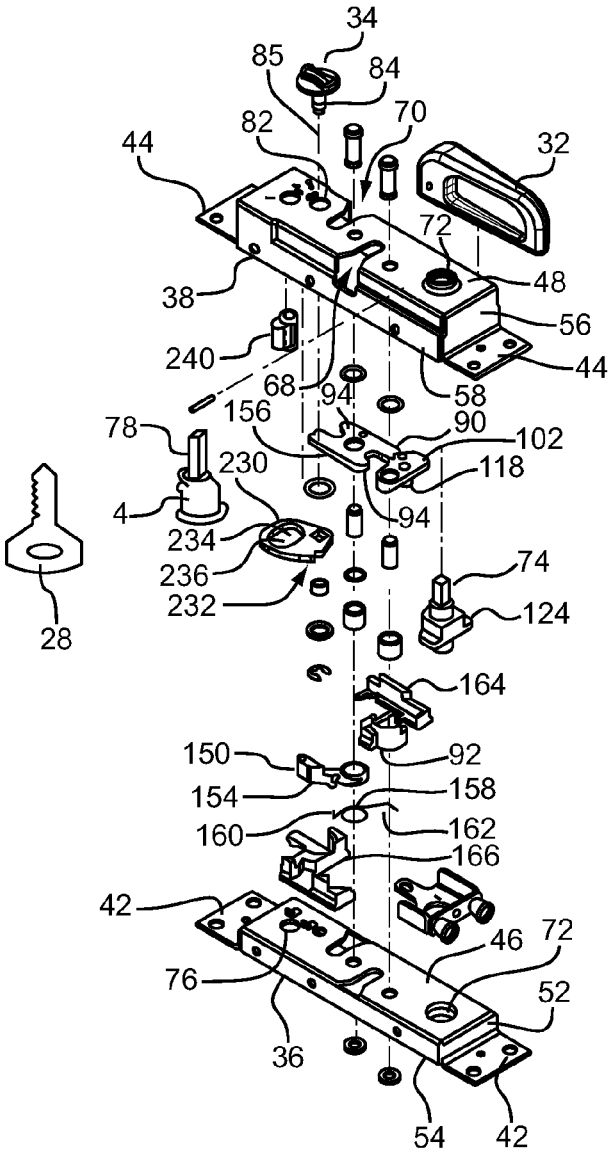
FIG. 11 is a top, exploded perspective view of the rotary lock shown in FIG. 7A.
Figure 12:
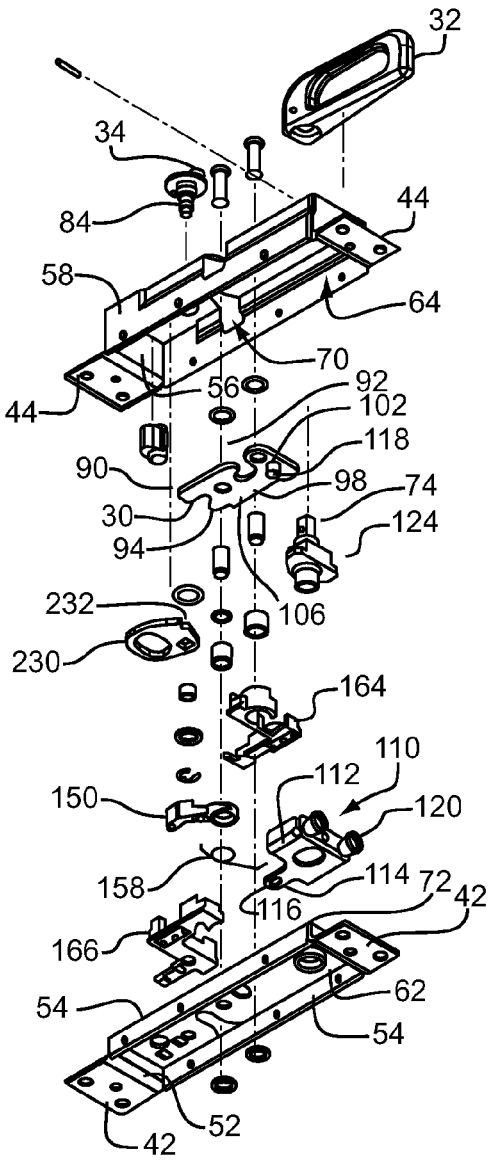
FIG. 12 is a bottom, exploded perspective view of the rotary lock shown in FIG. 7A.

In this position, the lock member 130 of the first embodiment may be moved (e.g., by rotation) to a lock position, either by manipulation of the interior actuator 34, or by way of rotation of the exterior actuator (e.g., key 28 and cam 140), which independently operate to rotate the lock member as shown in FIG. 6A. Conversely, the lock member 230 of the second embodiment cannot be moved to a lock position, since the lock blocker 150 is engaged with and prevents rotation of the lock member as shown in FIG. 9A. As used herein, the phrase "lock position" refers to a position of the lock member wherein the lock member 130, 230 is capable of engaging and securing the latch member 30 when in a primary latch position, even though the latch member may be in another position, such as an unlatched position.

Figure 5A:
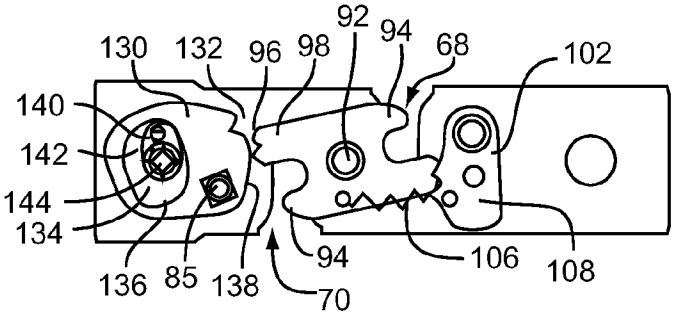
FIG. 5A is a schematic interior view of the rotary lock shown in FIG. 4A with the latch member in a secondary latch position and the lock member in an unlocked position.

As the door 20 is moved to the closed or open position, one of the strike components 40, 50 enters one of the strike channels 68, 70, engages the strike surface of either of the latching or locking portions 90, 98, and thereby rotates the latch member 30 from the unlatched position to a secondary latch position, as shown in FIGS. 5A and 8A. In the secondary latch position of the latch member, the strike engaging members 94 at least partially block the strike channels 68, 70 with the strike component 40, 50 trapped in the strike channel 68, 70 between the strike engaging member 94 and one of the latching or locking portions 90, 98 of the latch member. At the same time, the latching portion 90 of the latch member rotates relative to the keeper member 102, which is rotated and temporarily biased away from the latch member until the corresponding catch configurations 108, 96 are engaged, thereby releasably securing the latch member 30 in the secondary latch position with the keeper member 102 in a secondary keeper position. If unlocked, the handles 12, 32 can be rotated. Rotation of either handle 12, 32 moves the spring plate 112 against the force of the springs 120 and thereby draws the keeper member 102 away from the latch member 30, moving the keeper member from a secondary keeper position to a disengaged position and thereby releasing the latch member. The latch member 30 is then rotated to an unlatched position by way of the biasing force of the biasing member 106. In this position, the strike members 40, 50 are freely moveable out of the strike channels 68, 70.

If the lock member 130 is in a lock position in the first embodiment, the latch member 30 rotates the lock member 130 to an unlocked position as shown in FIGS. 5A and 6A as the latch member moves from an unlatched position to a secondary latch position. In any event, as the latch member 30 moves to the secondary latch position, the exterior profile 138 of the lock member 130 is shaped and positioned to abut the locking portion 98 of the latch member, thereby preventing the lock member 130 from being moved (e.g., rotated) to a lock position either by manipulation of the interior actuator 34, or by way of rotation of the exterior actuator, e.g., the key 28 and cam 140. Moreover, the cam surface 142 and inner cam surface 136 are shaped and positioned so as to prevent the cam and key from being rotated a substantial amount about rotation axis 144. For example, in one embodiment, the key is rotatable less than the full amount required to lock the door. For example, in one embodiment, where the key is normally rotated 90°, a limited rotation less than 90° would provide tactile and visual indicia that the door is not latched in a primary latch position. In one embodiment, the rotation of the actuator, or key, is limited to 15° less than a full lock rotation (e.g, (75°), while in another embodiment, the rotation of the actuator, or key, is limited to 30° less than a full lock rotation (e.g, 60°), while in another embodiment, the rotation of the actuator, or key, is limited to 45° less than a full lock rotation (e.g, 45°), while in another embodiment, the rotation of the actuator, or key, is limited to 60° less than a full lock rotation (e.g, 30°), while in another embodiment, the rotation of the actuator, or key, is limited to 75° less than a full lock rotation (e.g, 15°), while in another embodiment, the rotation of the actuator, or key, is limited to 80° less than a full lock rotation (e.g, 10°), while in another embodiment, the rotation of the actuator, or key, is limited to 85° less than a full lock rotation (e.g, 5°), while in another embodiment, the rotation of the actuator, or key, is limited to substantially no rotation. It should be understood that the less rotation allowed the actuator relative to the amount of rotation required to lock the door will provide greater indicia about the latched condition of the lock and door, with the most preferred limited rotation being less than 10°, and more preferably about 0°. In this way, the inability of the user to rotate the key 28 in a locking direction provides tactile and visual indicia that the door 20 is not and cannot be locked, and that the door and latch are therefore not in a primary latch position. Likewise, the interior actuator 34, which is non-rotatably coupled to the lock member 130, cannot be moved from an unlocked to a locked position, again providing tactile and visual indicia that the door is not and cannot be locked, and that the door and latch are therefore not in a primary latch position. As noted above, indicia 170 can be applied to the housing, with the actuator 34 including an indicator 172, configured for example as a pointer, directed at one or more of the indicia to provide additional visual indicia to the user. For example and without limitation, the indicia 170 can be configured in the form of alphanumeric characters (e.g., "U" for unlocked and "L" for locked), text ("Unlocked" and "Locked"), graphics, other characters or patterns, and/or combinations thereof. This type of auxiliary indicia can also be applied to the exterior of the housing, or on the plate, with the key member 28 acting as an indicator. In any event, the user, whether inside or outside the vehicle, is provided with indicia (by way of the feel and visual of the key 28 and interior actuator 34, as well as by the feel and visual of the indicia 170) that the door is not fully closed and the latch member is not fully engaged in the primary latch position, but rather is in a secondary latch position.

In the second embodiment, the lock blocker 150 remains engaged with the lock member 230 as the latch member 30 is moved to the secondary latch position as shown in FIG. 8. As such, the lock member 230 is prevented from being moved to a lock position by manipulation of the interior lock actuator 34, or by way of manipulation of the exterior lock actuator, e.g., through rotation of the key 28 and cam 240. Moreover, the cam 240 and inner cam surface 236 are shaped and positioned so as to prevent the cam 240 and key 28 from being rotated a substantial amount. For example, in one preferred embodiment, the key is not rotatable, while in other embodiments, the key is rotatable in varying limited amounts set forth above. In this way, the inability of the user to rotate the key 28 in a locking direction provides tactile and visual indicia that the door 20 is not and cannot be locked. As such, the user is provided with indicia that the door 20 is not fully closed and the latch member 30 is not fully engaged in the primary latch position. As with the first embodiment, additional indicia 170 can also be applied to the housing with the actuator having an indicator 172, such as a pointer, directed to the applicable indicia.

Figure 1A:
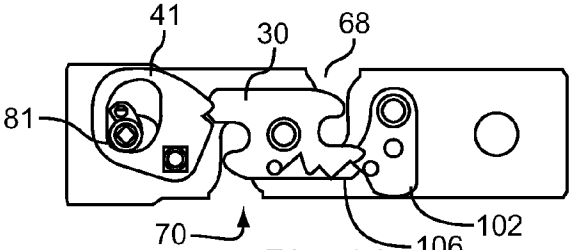
Fig. 1A (PRIOR ART)
FIG. 1A is a schematic interior view of a prior art rotary lock with a latch member in a primary latch position and a lock member in a lock position.
Figure 1B:
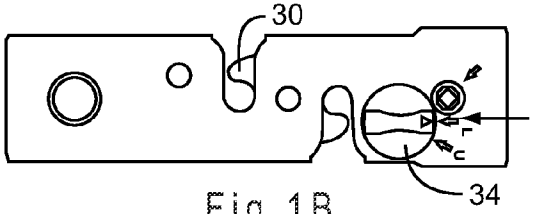
Fig. 1B (PRIOR ART)
FIG. 1B is a schematic exterior view of the prior art rotary lock shown in FIG. 1A.
Figure 2A:
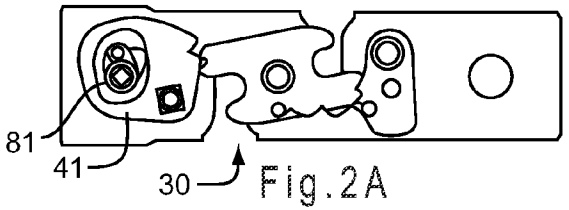
FIG. 2A is a schematic interior view of a prior art rotary lock with a latch member in a secondary latch position and a lock member in a pseudo-lock position.
Figure 2B:
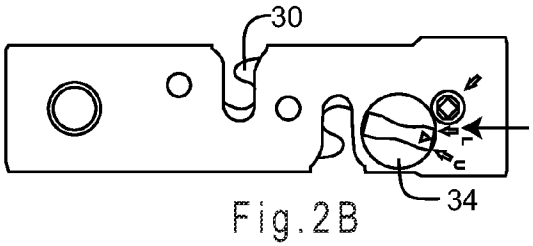
Fig. 2B (PRIOR ART)
FIG. 2B is a schematic exterior view of the prior art rotary lock shown in FIG. 2A.
Figure 3A:
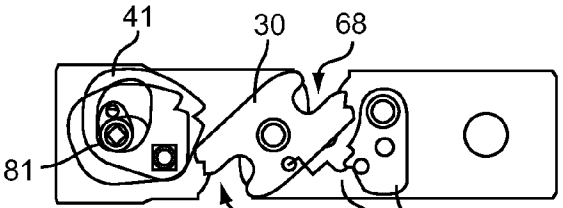
Fig. 3A (PRIOR ART)
FIG. 3A is a schematic interior view of a prior art rotary lock with a latch member in an unlatched position and a lock member in a lock position.
Figure 3B:
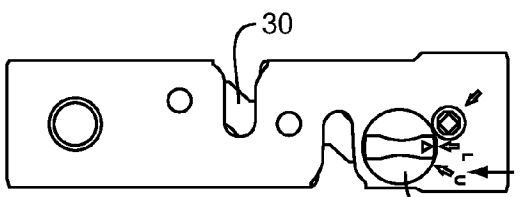
Fig. 3B (PRIOR ART)
FIG. 3B is a schematic exterior view of the prior art rotary lock shown in FIG. 3A.
Figure 4B:
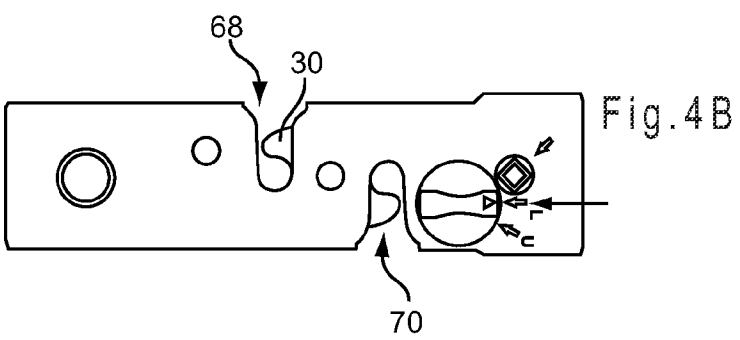
FIG. 4B is a schematic exterior view of the rotary lock shown in FIG. 4A.
Figure 5B:
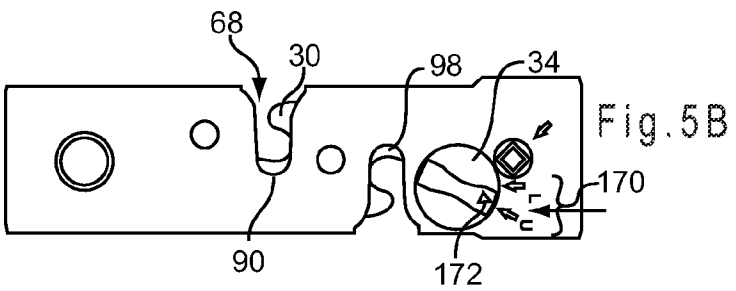
FIG. 5B is a schematic exterior view of the rotary lock shown in FIG. 5A.
Figure 6B:
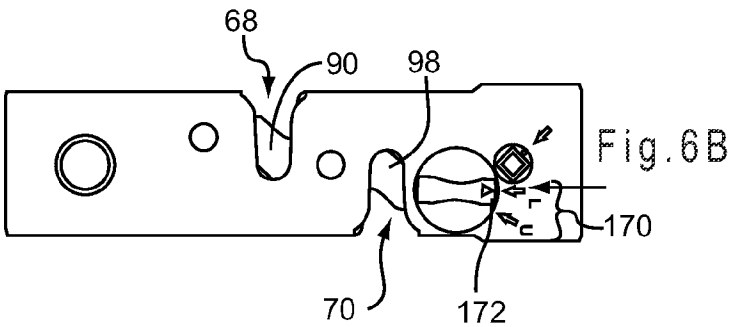
FIG. 6B is a schematic exterior view of the rotary lock shown in FIG. 6A.
Figure 4A:
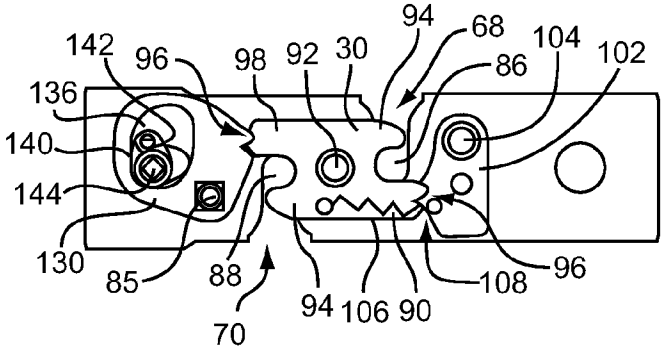
FIG. 4A is a schematic interior view of a first embodiment of a rotary lock with a latch member in a primary latch position and a lock member in a lock position.

As the door 20 is moved an additional amount, for example to the closed position, the strike component 40, 50 moves further into the strike channel 68, 70 and, through engagement with the strike surface of the latching and locking portions, rotates the latch member 30 from the secondary latch position to the primary latch position as shown in FIGS. 4A and 7A. In the primary latch position, the strike engaging members 94 substantially block the strike channels 68, 70 with the strike component 40, 50 trapped in a corresponding one of the strike channels 68, 70, depending on whether the door is in an open or closed position, between the strike engaging member 94, one of the latching or locking portions 90, 98 and/or an edge portion of the strike channel. At the same time, the latching portion 90 of the latch member again rotates relative to the keeper member 102, with the keeper member being rotated and temporarily biased away from the latch member until the corresponding catch configurations 108, 96 are further engaged. In this primary keeper position position, the keeper member 102 releasably secures the latch member 30 in the primary latch position. If unlocked, the handles 12, 32 can be rotated, which in turn moves the spring plate 112 and thereby draws the keeper member 102 away from the latch member 30, thereby decoupling the catch portions 96, 108 by moving the keeper member from a primary keeper position to a disengaged position. In this position, the keeper member 102 releases the latch member 30, which is then rotated to an unlatched position by way of the biasing force of the biasing member 106.

When the latch member 30 is in a primary latch position, as shown in the embodiment of FIG. 4A, the lock member 130 can be rotated to a lock position by the interior actuator 34 or by rotation of the exterior lock actuator, e.g., the key 28 and cam 140. For example, in one embodiment, the key is rotatable 90°. In this way, the user is provided with tactile and visual indicia that the door is fully closed and the latch member 130 is fully latched in a primary latch position. In addition, the actuators 34, 28 can function as an indicator 172 relative to indicia 170 on the housing, providing further visual and/or tactile indicia that the latch member 30 is fully latched in a primary latch position and can be locked in that position.

Referring to FIGS. 7A and 8A, as the latch member 230 is rotated from the secondary latch position to the primary latch position, the latch member 30 engages and rotates the lock blocker 150 from an engaged position, wherein the lock blocker prevents the lock member 230 from rotating to a lock position, to a disengaged position, wherein the lock blocker 150 does not impede the movement of the lock member 230, which lock member may then be rotated to a lock position as shown in FIG. 7A. In this position, the catch configuration 232 on the lock member engages the catch configuration 96 on the locking portion 98 of the latch member 30. The lock member 230 can be rotated to the lock position by way of the interior actuator 34, or by rotation of the exterior lock actuator, e.g., the key 28 and associated cam member 240. In this way, the user is provided with tactile and visual indicia that the door 20 is fully closed and the latch member 30 is fully latched in a primary latch position. In addition, the actuators 34, 28 can function as an indicator 172 relative to indicia 170 on the housing, providing further visual and/or tactile indicia that the latch member 30 is fully latched in a primary latch position and can be locked in that position.

In either embodiment, the latch member 30 is non-rotatable when the lock member 130, 230 is in the lock position, regardless of whether the keeper member 102 is engaged or disengaged with the latch member 30. To unlatch the door 20, the interior or exterior actuators 34, 28, 140, 240 are simply rotated to an unlock position, which in turn rotates the lock member 130, 230 to an unlock position. In a first embodiment, the lock member 130 is simply rotated out of the way, such that subsequent movement of the keeper member 102 to a disengaged position will release the latch member 30, which is rotated to an unlatched position by the biasing member 106. In this embodiment, as discussed above, the lock member 130 can be returned to a lock position when the latch member 30 is in a disengaged position, but the lock member 130 is non-movable to the lock position when the latch member 30 is in the secondary latch position. In the second embodiment, the lock member 230 is engaged by the lock blocker 150 as the lock member 230 is rotated to an unlock position, with the latch member 30 rotating away and disengaging from the lock blocker 150 as the latch member 30 moves to an unlatched position. In this embodiment, as discussed above, the lock member 230 is non-movable to the lock position when the latch member 30 is in either of the unlatched or secondary latched positions.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A rotary lock comprising:

a housing having a strike channel shaped to receive a strike component;

a latch member comprising at least one strike engaging member adapted to releasably engage the strike component, wherein said latch member is rotatable about a rotation axis between an unlatched position wherein said strike engaging member is positioned such that the strike component can be received in the strike channel, a secondary latch position wherein said strike engaging member at least partially blocks said strike channel and a primary latch position wherein said strike engaging member substantially blocks said strike channel;

a keeper member moveable between a disengaged position wherein said keeper member is disengaged from said latch member, a secondary keeper position wherein said keeper member is engaged with said latch member when said latch member is in said secondary latch position, and a primary keeper position wherein said keeper member is engaged with said latch member when said latch member is in said primary latch position;

a lock member moveable between a lock position and an unlock position, wherein said lock member is engaged with and prevents rotation of said latch member when said latch member is in said primary latch position and said lock member is in said lock position, wherein said lock member is disengaged from said latch member when said lock member is in said unlock position, and wherein said lock member is non-movable to said lock position when said latch member is in said secondary latch position; and a lock blocker moveable between an engaged position and a disengaged position, wherein said lock blocker engages said lock member and prevents said lock member from being moved to said lock position when said latch member is in said secondary latch position and said lock blocker is in said engaged position, and wherein said lock blocker does not impede the movement of said lock member to said lock position when said lock blocker is in said disengaged position.

2. The rotary lock of claim 1 wherein said strike channel comprises a first strike channel positioned on a first side of said housing to receive a first strike component, and further comprising a second strike channel positioned on an opposite second side of said housing to receive a second strike component, and wherein said at least one strike engaging member comprises a first strike engaging member movable relative to said first strike channel and adapted to releasably engage the first strike component, and a second strike engaging member adapted to releasably engage the second strike component, wherein said second strike engaging member is positioned such that the second strike element can be received in the second strike channel when said latch member is in said unlatched position, wherein said second strike engaging member at least partially blocks said second strike channel when said latch member is positioned in said secondary latch position, and wherein said second strike engaging member substantially blocks said second strike channel when said latch member is in said primary latch position.

3. The rotary lock of claim 2 wherein said latch member comprises a locking portion having a first catch configuration and a latching portion having a second catch configuration, wherein said keeper member comprises a third catch configuration, said third catch configuration engaging said second catch configuration when said keeper member is in said primary and secondary keeper positions and said latch member is in said primary and secondary latch positions respectively, and wherein said lock member comprises a fourth catch configuration, said fourth catch configuration engaging said first catch configuration when said lock member is in said lock position.

4. The rotary lock of claim 3 wherein said second and third catch configurations each comprise at least one tooth.

5. The rotary lock of claim 3 wherein said first and fourth catch configurations each comprise at least one tooth.

6. The rotary lock of claim 1 further comprising an actuator coupled to said lock member, wherein said actuator is moveable between an unlocked position and a locked position.

7. The rotary lock of claim 6 further comprising lock indicia positioned on said housing adjacent said actuator, wherein the position of said actuator relative to said lock indicia provides indicia about the position of said lock member.

8. The rotary lock of claim 6 wherein said actuator comprises a first actuator, and further comprising a second actuator coupled to said lock member, wherein said lock member is moveable between said lock position and said unlock position in response to movement of said second actuator.

9. The rotary lock of claim 8 wherein said lock member comprises a first cam surface and further comprising a cam member movably mounted to said housing and having a second cam surface engaging said first cam surface, wherein said lock member is moveable between said lock and unlock positions in response to movement of said second cam surface relative to said first cam surface.

10. The rotary lock of claim 1 wherein said lock blocker is rotatably mounted about said rotation axis.

11. The rotary lock of claim 10 wherein said lock blocker is engaged and moveable with said latch member in a first rotational direction from said engaged position to said disengaged position as said latch member is moved from said secondary latch position to said primary latch position.

12. The rotary lock of claim 11 wherein said lock blocker comprises an engagement surface engaged by said latch member when said latch member and said lock block are rotated in said first rotational direction.

13. The rotary lock of claim 11 wherein said lock blocker is disengageable from said latch member and independently moveable relative thereto in a second rotational direction opposite said first rotational direction as said latch member is moved from said primary latch position to said unlatched position.

14. The rotary lock of claim 13 comprising a biasing member biasing said lock blocker in said second rotation direction.

15. The rotary lock of claim 1 further comprising a biasing member coupled between said keeper member and said latch member.

16. The rotary lock of claim 15 further comprising an actuator coupled to said keeper member and moveable between first and second positions, wherein said keeper member is moved to said disengaged position in response to said movement of said actuator from said first position to said second position.

17. The rotary lock of claim 16 wherein said biasing member is a first biasing member, and further comprising a second biasing member biasing said actuator to said first position.

18. A vehicle comprising:

a doorway comprising first and second strike members disposed on opposite sides thereof;

a sliding door moveable between a closed and open position relative to said doorway; and a rotary lock according to claim 2 coupled to said sliding door.

19. A rotary lock comprising:

a housing having first and second strike channels positioned on opposite sides of said housing and shaped respectively to receive first and second strike components;

a latch member comprising opposing first and second strike engaging members adapted to releasably engage respectively the first and second strike components, wherein said latch member is rotatable about a rotation axis between an unlatched position, a secondary latch position and a primary latch position;

a keeper member moveable between a disengaged position wherein said keeper member is disengaged from said latch member such that said latch member is rotatable between said primary and unlatched positions, a secondary keeper position wherein said keeper member is engaged with said latch member when said latch member is in said secondary latch position, and a primary keeper position wherein said keeper member is engaged with said latch member when said latch member is in said primary latch position;

a lock member moveable between a lock position and an unlock position, wherein said lock member is engaged with and prevents rotation of said latch member when said latch member is in said primary latch position and said lock member is in said lock position, wherein said lock member is disengaged from said latch member when said lock member is in said unlock position; and a lock blocker rotatable about said rotation axis between an engaged position, wherein said lock blocker engages said lock member and prevents said lock member from being moved to said lock position when said latch member is in said secondary latch position, and a disengaged position, wherein said lock blocker does not impede the movement of said lock member to said lock position.

20. The rotary lock of claim 19 wherein said lock blocker is engaged and moveable with said latch member from said engaged position to said disengaged position as said latch member is rotated in a first rotational direction from said secondary latch position to said primary latch position, wherein said lock blocker comprises an engagement surface engaged by said latch member when said latch member and said lock blocker are rotated in said first rotational direction, and wherein said lock blocker is disengaged from said latch member and independently moveable relative thereto in a second rotational direction opposite said first rotational direction as said latch member is moved from said primary latch position to said unlatched position, and further comprising a biasing member biasing said lock blocker in said second rotation direction.

21. A method of locking a sliding door in an open or closed position comprising:

moving a sliding door comprising a rotary latch relative to a door opening having first and second strike members;

disposing one of said first and second strike elements through one of a first and second strike channel formed in said rotary latch and thereby rotating a latch member with said one of said first and second strike elements from an unlatched position to a secondary latch position;

engaging a keeper member with said latch member as said latch member is rotated to said secondary latch position disengaging said keeper member from said latch member such that said latch member is rotatable between said primary and unlatched positions;

preventing a lock member from moving to a lock position when said latch member is in said secondary latch position and thereby providing indicia that said latch member is not in a primary latch position, wherein said preventing said lock member from moving to said lock position when said secondary latch position comprises engaging said lock member with a lock blocker, and wherein said moving said lock member to said lock position comprises disengaging said lock blocker from said lock member;

rotating said latch member with said one of said first and second strike elements from said secondary latch position to said primary latch position;

engaging said keeper member with said latch member as said latch member is rotated from said secondary latch position to said primary latch position; and moving said lock member to a lock position and thereby engaging said latch member with said lock member when said latch member is in said primary latch position.

22. The method of claim 21 wherein said disengaging said lock blocker from said lock member comprises engaging said lock blocker with said latch member and rotating said lock blocker with said latch member.

23. A rotary lock comprising:

a housing having a strike channel shaped to receive a strike component;

a latch member comprising at least one strike engaging member adapted to releasably engage the strike component, wherein said latch member is rotatable about a rotation axis between an unlatched position, a secondary latch position and a primary latch position; a keeper member moveable between a disengaged position wherein said keeper member is disengaged from said latch member, a secondary keeper position wherein said keeper member is engaged with said latch member when said latch member is in said secondary latch position, and a primary keeper position wherein said keeper member is engaged with said latch member when said latch member is in said primary latch position a lock member moveable between a lock position and an unlock position, wherein said lock member is engaged with and prevents rotation of said latch member when said latch member is in said primary latch position and said lock member is in said lock position, wherein said lock member is disengaged from said latch member when said lock member is in said unlock position;

an exterior lock actuator moveable between a neutral position and a lock position, wherein said lock member is moveable to said lock position in response to said exterior lock actuator being moved to said lock position, and wherein said exterior lock actuator is non-moveable to said lock position when said latch member is in said secondary latch position; and a lock blocker moveable between an engaged position and a disengaged position, wherein said lock blocker engages said lock member and prevents said lock member from being moved to said lock position when said latch member is in said secondary latch position and said lock blocker is in said engaged position, and wherein said lock blocker does not impede the movement of said lock member to said lock position when said lock blocker is in said disengaged position.

24. The rotary lock of claim 1 wherein said lock blocker directly engages said lock member when said lock blocker is in said engaged position.

25. The rotary lock of claim 19 wherein said lock blocker directly engages said lock member when said lock blocker is in said engaged position.

26. The method of claim 21 wherein said engaging said lock member with said lock blocker comprises directly engaging said lock member with said lock blocker.

27. The rotary lock of claim 23 wherein said lock blocker directly engages said lock member when said lock blocker is in said engaged position.

* * * * *